US006946787B2

(12) United States Patent
Oh

(10) Patent No.: US 6,946,787 B2
(45) Date of Patent: Sep. 20, 2005

(54) FIELD EMISSION DISPLAY DEVICE

(75) Inventor: Tae-Sik Oh, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 237 days.

(21) Appl. No.: 10/624,736

(22) Filed: Jul. 21, 2003

(65) Prior Publication Data

US 2004/0130258 A1 Jul. 8, 2004

(30) Foreign Application Priority Data

Jan. 7, 2003 (KR) ..... 10-2003-0000812

(51) Int. Cl.[7] ..... H01J 1/62; H01J 63/04
(52) U.S. Cl. ..... 313/497; 313/496
(58) Field of Search ..... 313/495, 496, 313/497, 293–304

(56) References Cited

U.S. PATENT DOCUMENTS

| | | | |
|---|---|---|---|
| 6,062,931 A | 5/2000 | Chuang et al. | |
| 6,097,138 A | 8/2000 | Nakamoto | |
| 6,420,726 B2 | 7/2002 | Choi et al. | |
| 2003/0001490 A1 * | 1/2003 | Yamamoto et al. | 313/495 |

FOREIGN PATENT DOCUMENTS

JP 2000-268704 9/2000

OTHER PUBLICATIONS

Patent Abstract of Japan, Publication No. 2000–298704, Published on Sep. 29, 2000, in the name of Ito Shigeo et al.

Patent Abstract of Japan for Publication No. 2000–268704, Publication Date Sep. 29, 2000, in the name of Ito Shigeo et al.

* cited by examiner

*Primary Examiner*—Mariceli Santiago
*Assistant Examiner*—Elizabeth Rielley
(74) *Attorney, Agent, or Firm*—Christie, Parker and Hale, LLP

(57) ABSTRACT

A field emission display includes first and second substrates provided with a predetermined gap therebetween. At least one gate electrode is formed on the first substrate. Cathode electrodes are formed in a predetermined pattern, the cathode electrodes including openings where the cathode electrodes intersect the gate electrode. An insulation layer is formed between the at least one gate electrode and the cathode electrodes. Counter electrodes are formed smaller than and within the openings. Emitters are provided contacting the cathode electrodes. An anode electrode is formed on at least one side of the second substrate. Phosphor layers are formed in a predetermined pattern on at least one side of the anode electrode. Two of the emitters are provided on opposite sides of each of the counter electrodes, each of the emitters including two short sides contacting the corresponding cathode electrode and one long side.

27 Claims, 8 Drawing Sheets

FIELD EMISSION DISPLAY DEVICE

CROSS-REFERENCE TO RELATED APPLICATION

This application claims priority to and the benefit of Korean Application No. 2003-812, filed on Jan. 7, 2003 in the Korean Industrial Property Office, the entire disclosure of which is incorporated herein by reference.

BACKGROUND OF THE INVENTION (a) Field of the Invention

The present invention relates to field emission displays (FEDs) device, and more particularly, to FED devices including emitters that are realized through carbon nanotubes.

(b) Description of the Related Art

In modern FEDs a thick-layer process such as screen printing is used to form electron emission sources (i.e., emitters) in a flat configuration utilizing a carbon-based material that emits electrons at low voltage driving conditions (10–100V).

Carbon-based materials suitable for forming the emitters include graphite, diamond, diamond-like carbon, and carbon nanotubes (CNTs). Among these, carbon nanotubes appear to be very promising for use as emitters because of their extremely minute tips with a radius of curvature of approximately tens to several tens of nanometers, and because carbon nanotubes are able to emit electrons in low electric field conditions of about 1–10V/$\mu$m.

U.S. Pat. Nos. 6,062,931 and 6,097,138 disclose cold cathode field emission displays that are related to this area of FEDs using CNT technology.

In general, the FEDs employ a triode structure having cathode electrodes, an anode electrode, and gate electrodes. During manufacture of such FEDs, cathode electrodes are first formed on a substrate. Then after providing emitters on the cathode electrodes, gate electrodes are formed on the emitters.

However, with the triode structure as described above, it is difficult to satisfactorily form the emitters with holes provided in the gate electrodes and in an insulation layer formed under the gate electrodes. That is, in the process of filling the holes with an emitter material, the conductive emitter material extends between the cathode electrodes and gate electrodes to short circuit these two elements.

Further, with the conventional triode structure, when the electrons emitted from the emitters are formed into electron beams and pass over the gate electrodes (to which a positive voltage is applied) while traveling toward the phosphor layers, a diverging force of the electron beams is increased by influence of the gate electrodes such that the electron beams disperse. As a result, the electron beams land on a phosphor layer of a pixel adjacent to an intended pixel to illuminate this phosphor layer. This reduces color purity such that overall picture quality deteriorates.

To remedy this problem, there has been disclosed a configuration in which a mesh metal grid is provided between the cathode electrodes and anode electrode in an effort to realize good focusing control of the electrons emitted from the emitters. Japanese Laid-Open Patent No. 2000-268704 discloses such an FED.

In an FED having the metal grid, in addition to the advantages described, damage to the structure of the rear substrate on which the emitters are formed is prevented from arcing which results from the high voltage applied to the anode electrode. However, when electron beams are emitted from the emitters, there are electron beams that are blocked by the metal grid and do not pass through holes formed therein. These electron beams instead strike the metal grid, which decreases the utilization efficiency of the electron beams. Because the final amount of electron beams reaching the phosphors is lowered, picture brightness is reduced.

Such a problem may become worse in FEDs in which the gate electrodes are provided under the cathode electrodes and the emitters are formed on the cathode electrodes such as in U.S. Pat. No. 6,420,726 disclosed by the applicant. Since most of the emission of the electron beams occurs from the edges of the emitters, it is difficult for the electron beams to pass through the metal grid unimpaired. Accordingly, the amount of the electron beams for illuminating the phosphors is significantly reduced.

Further, in such a conventional FED in which electron emission occurs along one edge of the emitters, the electron beam emission area of the emitters is small such that there is a limit to increasing the size and density of electron beams reaching the phosphor layers. Also, with the small emission area, driving the FED for long periods in a high current range may cause damage to the emitters, thereby potentially reducing their lifespan.

SUMMARY OF THE INVENTION

In accordance with an embodiment of the present invention a field emission display device is provided that controls paths through which electron beams emitted from emitters travel to improve a color purity of a screen and picture quality, and that increases an area of electron beam emission to increase brightness and prevent damage to emitters.

In one embodiment, the present invention provides a field emission display device including first and second substrates opposing one another with a predetermined gap therebetween. At least one gate electrode is formed on the first substrate. Cathode electrodes are formed in a predetermined pattern, the cathode electrodes including openings that are formed where the cathode electrodes intersect the gate electrode. An insulation layer is formed between the at least one gate electrode and the cathode electrodes. Counter electrodes are formed in the openings and with predetermined dimensions such that predetermined gaps are formed between the counter electrodes and the cathode electrodes. Emitters are provided contacting the cathode electrodes. An anode electrode is formed on at least one side of the second substrate opposing the first substrate. Phosphor layers are formed in a predetermined pattern on at least one side of the anode electrode. Two of the emitters are provided on opposite sides of each of the counter electrodes, each of the emitters including one long side in proximity to the corresponding counter electrode and two short sides contacting the corresponding cathode electrode.

The counter electrodes contact the gate electrode through holes formed in the insulating layer such that the counter electrodes are electrically connected to the gate electrode.

Each of the cathode electrodes includes a pair of emitter-receiving sections formed by extending the openings of the cathode electrodes to predetermined dimensions on opposite sides of the counter electrodes. The emitters are provided within the emitter-receiving sections and with its short sides contacting the cathode electrodes such that the emitters close an entrance side of the emitter-receiving sections to thereby form spaces between the emitters and the cathode electrodes.

The emitters include a second long side that is positioned at a predetermined distance from the cathode electrodes. The emitters may be made of carbon material such as carbon nanotubes, graphite, diamond, diamond-like carbon, and $C_{60}$ (Fullerene), or a mixture of these materials.

Two or more emitters may be separately provided in each of the emitter-receiving sections. Also, dimensions of the short sides are varied to control a contact area with the cathode electrodes, or grooves are formed in side walls of the cathode electrodes within the emitter-receiving sections and ends of the emitters are inserted within the grooves to thereby vary a contact area of the emitters with the cathode electrodes.

A mesh grid is mounted between the cathode electrodes and the anode electrode, and a metal thin film layer is formed on the phosphor layers.

In accordance with further embodiments of the present invention, a field emission display is provided having a first substrate and at least one gate electrode formed in a predetermined gate electrode pattern on the first substrate. A plurality of cathode electrodes are formed in a predetermined cathode electrode pattern. An insulation layer is formed between the at least one gate electrode and the plurality of cathode electrodes. Emitters electrically contact the cathode electrodes. A second substrate opposes the first substrate with a predetermined gap therebetween, the first substrate and the second substrate forming a vacuum container. At least one anode electrode is formed in a predetermined anode electrode pattern on a surface of the second substrate opposing the first substrate. Phosphor layers are formed in a predetermined phosphor layer pattern on the at least one anode electrode. A pixel region is formed between an emitter and a respective phosphor layer of the predetermined phosphor layer pattern at each intersection of: a cathode electrode and a gate electrode when the anode electrode is a common anode electrode, or a cathode electrode and an anode electrode when the gate electrode is a common gate electrode. Counter electrodes are formed in openings in the cathode formed at each intersection and with predetermined dimensions such that predetermined gaps are formed between the counter electrodes and the cathode electrodes. Two of the emitters are provided on opposite sides of each of the counter electrodes, each of the emitters including one long side in proximity to the corresponding counter electrode and two short sides contacting the corresponding cathode electrode. Predetermined voltages are applied to the at least one anode electrode, cathode electrodes, counter electrodes and the at least one gate electrode generating an electric field between respective gate electrodes and the emitters such that electrons emitted from emitters are induced toward and strike the phosphor layer in a corresponding pixel region to realize predetermined images. The at least one gate electrode formed in a predetermined gate electrode pattern may be a plurality of gate electrodes formed in a striped pattern, with the at least one anode electrode being one anode electrode functioning as a common electrode. The at least one anode electrode formed in a predetermined anode electrode pattern may be a plurality of anode electrodes formed in a striped pattern, with the at least one gate electrode being one gate electrode functioning as the common electrode.

Those skilled in the art would appreciate that with the cathode electrodes could be scanning electrodes with the plurality of gate electrodes providing data information, or vice versa. Similarly, with the cathode electrodes being scanning electrodes, the plurality of anode electrodes could provide data information, or vice versa.

DETAILED DESCRIPTION

Figure 1:
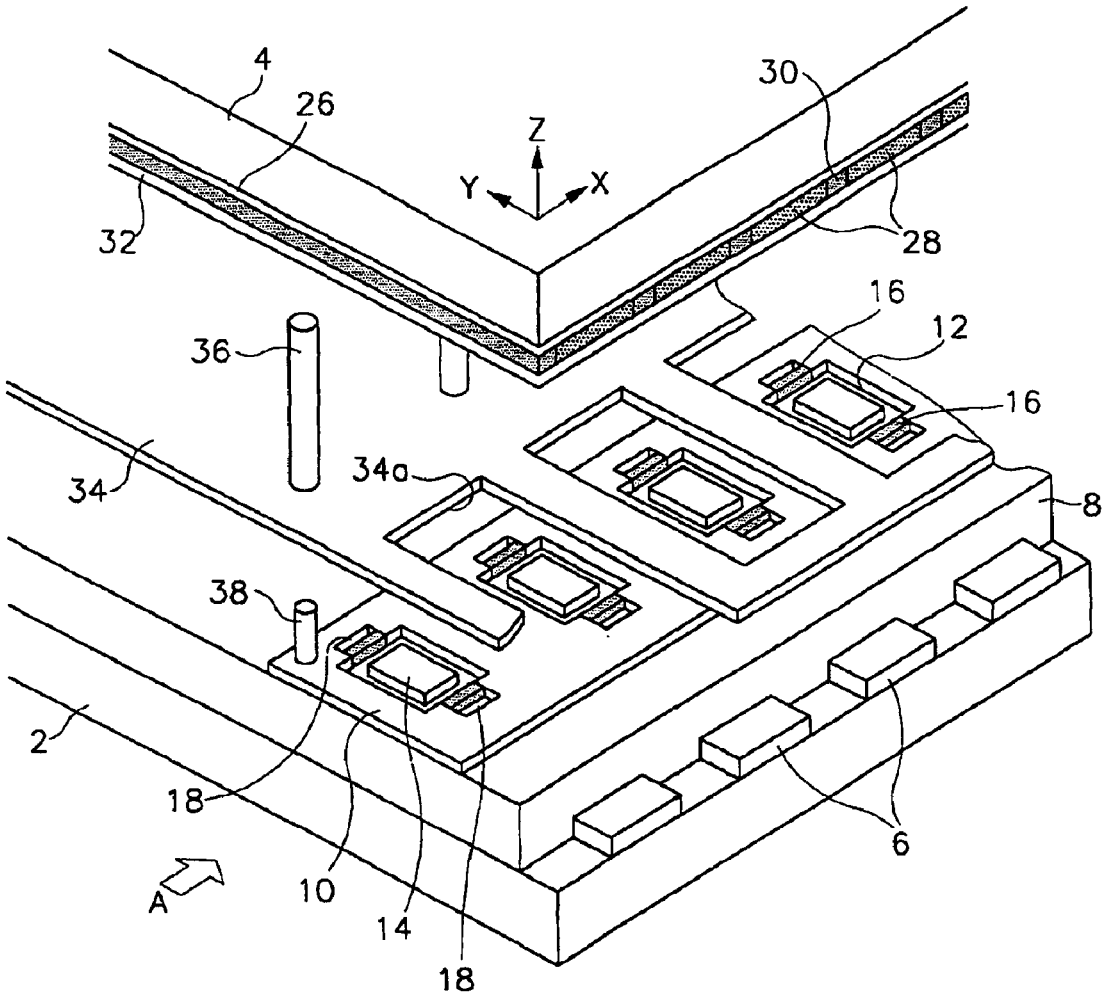
FIG. 1 is a partial exploded view of a field emission display according to an embodiment of the present invention.
Figure 2:
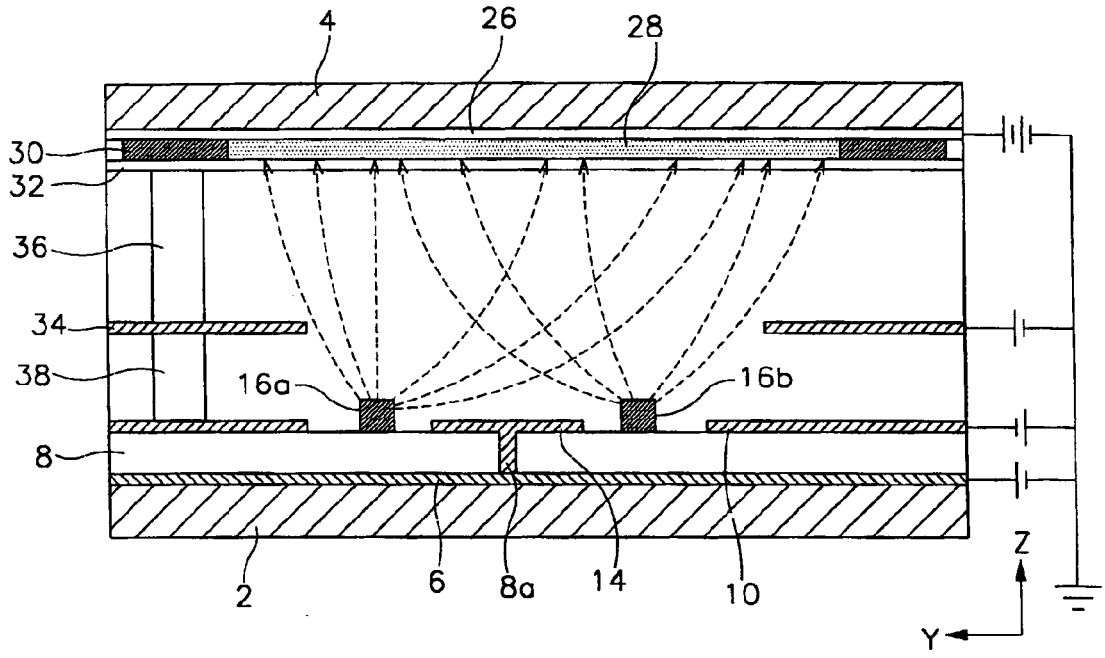
FIG. 2 is a partial sectional view of the field emission display of FIG. 1, in which the field emission display is shown in an assembled state.

FIG. 1 is a partial exploded view of an FED according to an embodiment of the present invention. FIG. 2 is a partial sectional view of the FED of FIG. 1, in which the FED is shown in an assembled state. The sectional view of FIG. 2 is as viewed from direction A of FIG. 1.

The FED includes first substrate 2 of predetermined dimensions (hereinafter referred to as a rear substrate) and second substrate 4 of predetermined dimensions (hereinafter referred to as a front substrate). Front substrate 4 is provided opposing rear substrate 2 with a predetermined gap therebetween. A structure to enable the emission of electrons by forming an electric field is provided on rear substrate 2 and a structure to enable the realization of predetermined images by the interaction with emitted electrons is provided on front substrate 4.

Those skilled in the art would appreciate that the cathode electrodes would typically function as scanning electrodes while the gate electrodes provide data information, or vice versa.

In more detail, transparent gate electrodes 6 are formed on rear substrate 2 in a predetermined pattern (e.g., a striped pattern) along an axis Y direction. Further, transparent insulation layer 8 is formed over an entire surface of rear substrate 2 covering gate electrodes 6. Opaque cathode electrodes 10 are formed on insulation layer 8 in a predetermined pattern (e.g., a striped pattern), at predetermined intervals, and along an axis X direction of FIG. 1, only one of the cathode electrodes being shown. Accordingly, cathode electrodes 10 are perpendicular to gate electrodes 6.

In the case where pixel regions are defined at locations of intersection between cathode electrodes 10 and gate electrodes 6, openings 12 are formed by removing conductive material forming cathode electrodes 10 at areas corresponding to the pixel regions. Also, counter electrodes 14 are formed in centers of openings 12 in a state electrically contacted to gate electrodes 6.

That is, holes 8*a* are formed in insulation layer 8, and material forming counter electrodes 14 is extended into holes 8*a* to make contact with gate electrodes 6, or another conductive material is provided in holes 8*a* to interconnect counter electrodes 14 and gate electrodes 6.

During operation of the FED, a predetermined drive voltage is applied to gate electrodes 6 to form electric fields for the emission of electrons between counter electrodes 14 and emitters 16. Counter electrodes 14 form additional electric fields in a direction toward the emitters 16 to enhance electron emission. Accordingly, counter electrodes 14 enable a reduction in drive voltage, and allow for the favorable emission of electrons from emitters 16.

Each of the cathode electrodes 10 further includes a pair of emitter-receiving sections 18 that extend in opposite directions along the axis Y direction. Emitter-receiving sections 18 are an extension of openings 12 and are formed in the same manner as the openings, namely, by removing predetermined portions of the conductive material forming the cathode electrodes 10 such that insulation layer 8 is exposed. Also, emitter-receiving sections 18 are substantially rectangular, with one long side being open and formed by an imaginary line where the formation of emitter-receiving sections 18 begins.

One of the emitters 16, which are rectangular in shape, is positioned in each of the emitter-receiving sections 18. Emitters 16 are provided in emitter-receiving sections 18 with only short sides contacting side walls of cathode electrodes 10. Also, emitters 16 are smaller in size than emitter-receiving sections 18 and are provided with one long side substantially aligned with the open side of emitter-receiving sections 18. As a result, closed spaces are formed between emitters 16 and cathode electrodes 10 within emitter-receiving sections 18.

Figure 3:
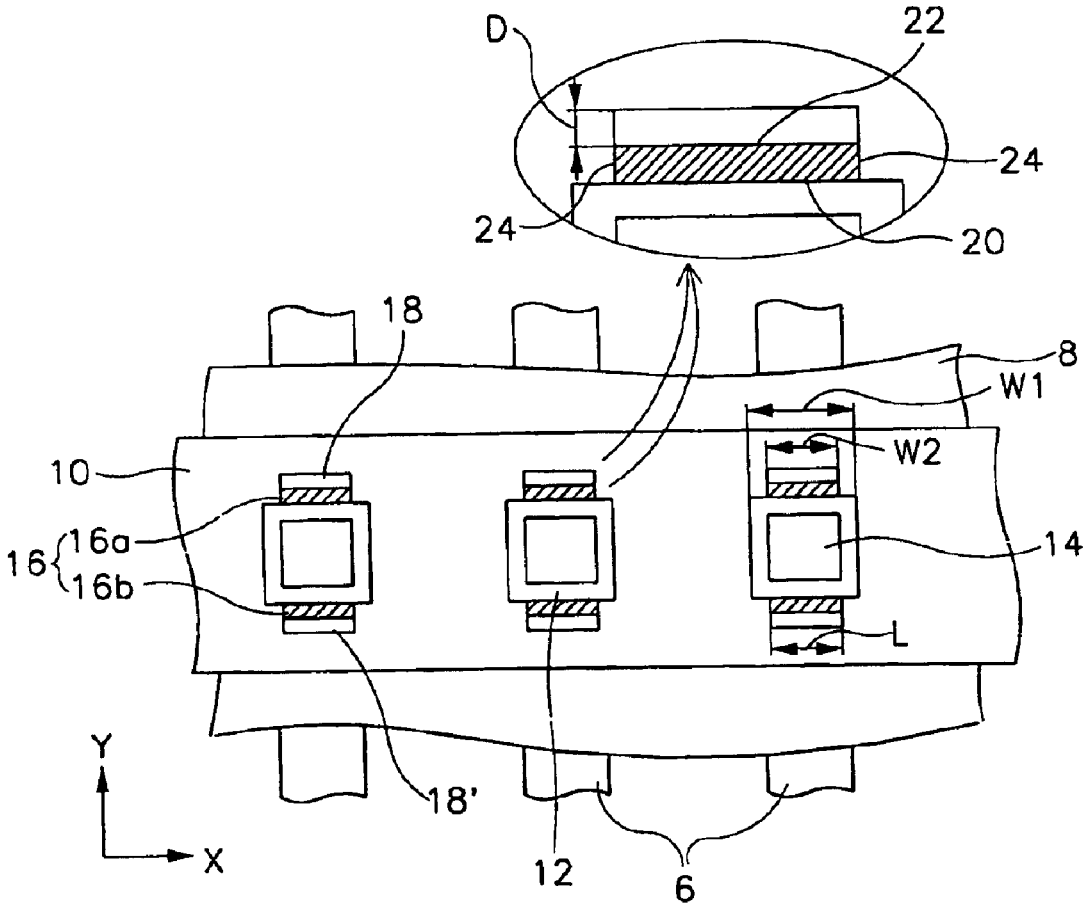
FIG. 3 is a partial plan view of a rear substrate of FIG. 1.

FIG. 3 is a partial plan view of rear substrate 2. A single emitter configuration will be described and it is to be assumed that the same structure is repeated for all the pixel regions.

First emitter 16*a* is positioned in one emitter-receiving section 18, and second emitter 16*b* is positioned in the other receiving section 18. Each of the emitters 16 includes first long side 20 closest to corresponding counter electrode 14, second long side 22 provided at predetermined distance (D) from cathode electrode 10, and two short sides 24 closely contacting side surfaces of cathode electrode 10.

Emitters 16 may be made of a carbon-based material such as carbon nanotubes, graphite, diamond, diamond-like carbon, and $C_{60}$ (Fullerene), or they are made of a mixture of these carbon-based materials. Carbon nanotubes are used in accordance with an exemplary embodiment the present invention.

Length (L) of emitter-receiving sections 18 and emitters 16 along the axis X direction is either identical to or smaller than a width (W1) of the opening 12. Preferably, length (L) of emitter-receiving sections 18 and emitters 16 is substantially identical to width (W2) of counter electrode 14 along the axis X direction.

With this configuration and again viewing the FED as a whole, emitters 16 receive a voltage needed for electron emission through short sides 24 of emitters 16 contacting cathode electrodes 10. Further, when a predetermined drive voltage is applied between cathode electrodes 10 and gate electrodes 6, electrons are emitted from first long sides 20 of emitters 16 opposing counter electrodes 14, as well as from second long sides 22 positioned at the predetermined distance (D) from cathode electrodes 10 as described above.

This is the result of electric fields being formed in the vicinity of second long sides 22 of emitters 16. That is, with the exposure of insulation layer 8 at specific areas under cathode electrodes 10, when a predetermined drive voltage is applied to gate electrodes 6, electric fields of gate electrodes 6 are easily formed through emitter-receiving sections 18 and through the exposed areas of insulation layer 8.

With respect to front substrate 4, formed on a surface thereof opposing the rear substrate are anode electrode 26 and red (R), green (G), and blue (B) phosphor layers 28. Phosphor layers 28 are provided on anode electrode 26 at predetermined intervals and along the axis Y direction. Further, black matrix layers 30 are formed between R, G, and B phosphor layers 28 to improve picture contrast. Thin film layer 32 is formed over black matrix layers 30 and phosphor layers 28. Thin film layer 32 is made of a metal such as aluminum and acts to improve withstand voltage and brightness characteristics of the FED.

Mesh grid 34, including plurality of holes 34*a*, is also mounted between front substrate 4 and rear substrate 2. Mesh grid 34 prevents damage caused by arcing and acts to focus the electrons emitted from emitters 16.

A plurality of upper spacers 36 is mounted in non-pixel regions and between front substrate 4 and mesh grid 34 such that a predetermined space is maintained between front substrate 4 and mesh grid 34. Also, a plurality of lower spacers 38 is mounted in non-pixel regions and between rear substrate 2 and mesh grid 34 such that a predetermined space is maintained between rear substrate 2 and mesh grid 34.

Front substrate 4 and rear substrate 2 structured as in the above are connected using a sealant in a state where cathode electrodes 10 and phosphor layers 28 are perpendicular to one another. A space formed between rear substrate 2 and front substrate 4 is then evacuated to realize a vacuum therebetween, thereby completing the FED.

In the FED structured as in the above, predetermined external voltages are applied to gate electrodes 6, cathode electrodes 10, anode electrode 26, and mesh grid 34 to drive the FED. For example, a positive voltage of a few to a few tens of volts is applied to gate electrodes 6, a negative voltage of a few to a few tens of volts is applied to cathode electrodes 10, a positive voltage of a few hundred to a few thousand volts is applied to anode electrode 26, and a positive voltage of a few tens to a few hundred volts is applied to mesh grid 34.

Therefore, electric fields are formed in the peripheries of emitters 16 by the difference in voltage between gate electrodes 6 and cathode electrodes 10 such that electrons are emitted from emitters 16. Also, since in each pixel region there are mounted first emitter 16*a* and second emitter 16*b* on opposite sides of each of the counter electrodes 14, electric fields are concentrated at first long side 20 and second long side 22 of both first emitter 16*a* and second emitter 16*b*. This results in electron emission from four areas in each pixel region.

The electrons emitted from emitters 16 are attracted by the positive voltage applied to counter electrodes 14 to receive a force in the direction of counter electrodes 14. However, the electron beams emitted from first emitters 16*a* and deflected toward counter electrodes 14 receive a strong repelling force by the negative voltage of cathode electrodes 10 surrounding second emitters 16*b* to be focused, and, similarly, the electron beams emitted from second emitters 16*b* and deflected toward counter electrodes 14 receive a strong repelling force by the negative voltage of cathode electrodes 10 surrounding first emitters 16*a* to be focused.

Accordingly, the electron beams that are focused after emission from emitters 16 are attracted by the positive voltage applied to mesh grid 34 and fully pass through holes 34*a* of mesh grid 34 while traveling toward front substrate 4. The electron beams are then attracted by the high positive voltage applied to anode electrode 26 to thereby land on phosphor layers 28 and illuminate the same.

Figure 4A:
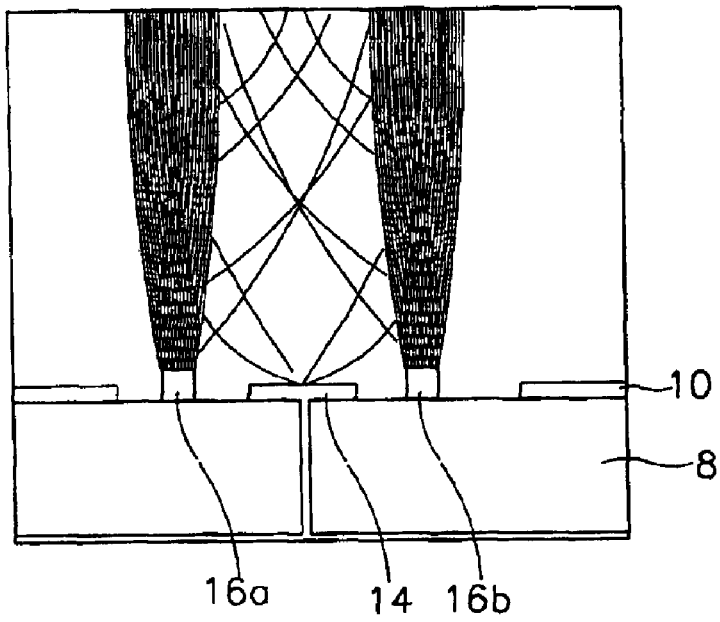
FIGS. 4*a* and 4*b* show results of a computer simulation illustrating traces of electron beams emitted from emitters of a field emission display according to an embodiment of the present invention.
Figure 4B:
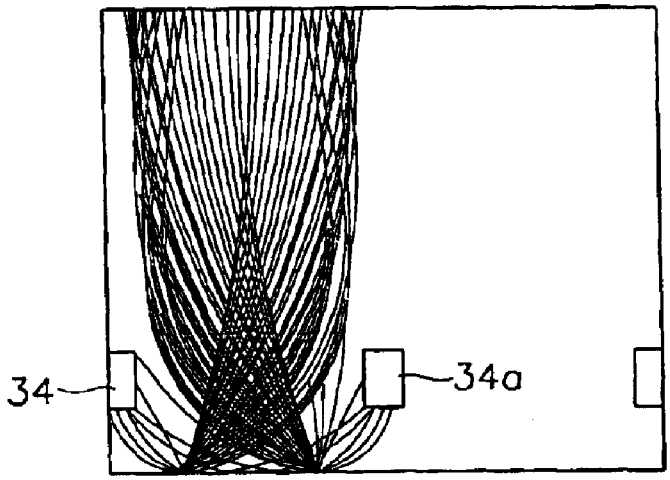

FIGS. 4*a* and 4*b* show results of a computer simulation illustrating traces of electron beams emitted from emitters 16 of the FED according to an embodiment of the present invention. FIG. 4*a* shows traces of electron beams in the vicinity of a pair of the emitters, while FIG. 4*b* shows traces of electron beams as they pass through one of the holes 34*a* of mesh grid 34 and travel toward phosphor layers 28.

As shown in the drawings, an electron beam is formed by the emission of electrons from the first and second long sides of first emitter 16*a*. Although part of this electron beam is deflected toward counter electrode 14, it does not travel past second emitter 16*b* while being focused toward front substrate 4. Similarly, an electron beam is formed by the emission of electrons from the first and second long sides of second emitter 16*b*. Part of this electron beam is also deflected toward counter electrode 14 but it does not travel past first emitter 16*a* while being focused toward front substrate 4.

Accordingly, the electron beams emitted from first and second emitters 16*a* and 16*b* are irradiated in substantially equal amounts to travel toward centers of phosphor layers 28. The electron beams emitted from one pixel region fully pass through the corresponding hole 34*a* of mesh grid 34 to selectively land on phosphor layers 28 of the corresponding pixel.

Figure 5A:
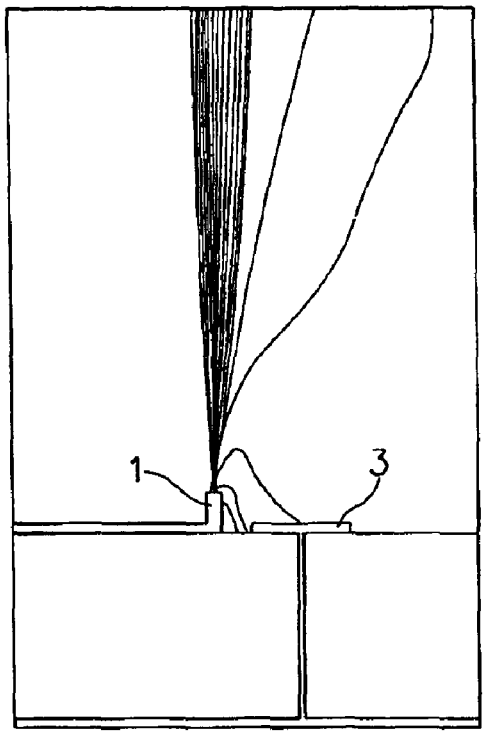
FIG.5A (Prior Art)
FIGS. 5*a* and 5*b* show results of a computer simulation illustrating traces of electron beams emitted from emitters of a conventional field emission display.
Figure 5B:
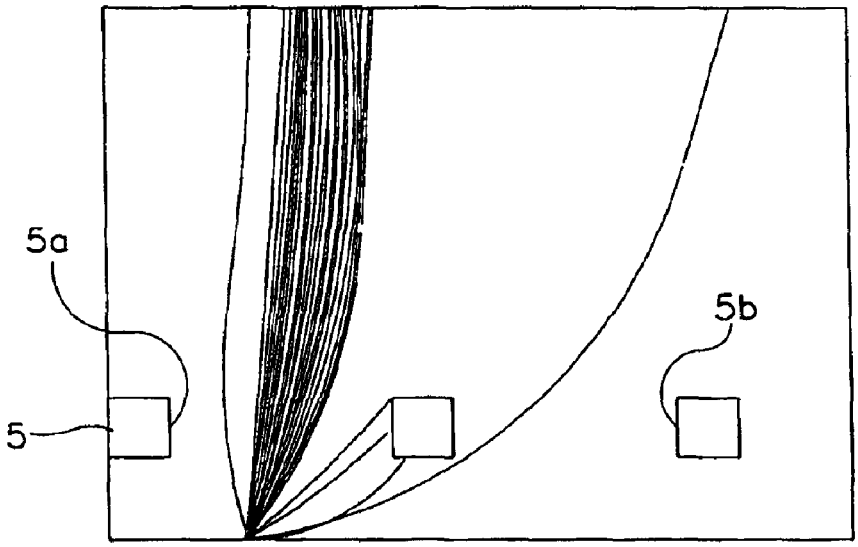
FIG.5B (Prior Art)

FIGS. 5*a* and 5*b* show results of a computer simulation illustrating traces of electron beams emitted from emitters of a conventional field emission display. In contrast to the FED of the present invention, in the conventional FED, an electron beam emitted from emitter 1 is deflected toward counter electrode 3 while traveling toward a front substrate such that part of the electron beam does not pass through hole 5*a* of mesh grid 5 and is instead blocked by the same. A significant portion of the electron beam is therefore lost. Part of the electron beam also leaks through hole 5*b* of mesh grid 5 of a subsequent cathode electrode.

Therefore, in the FED of an embodiment of the present invention, the electron beams are focused to realize sharp pictures. Also, electrons are emitted from both first long side 20 and second long side 22 of each of the emitters 16 so that the electron beams cover a larger area and are more dense. This acts to improve screen brightness. Further, with the increase in the electron emission area of emitters 16, damage to emitters 16 when the FED is driven for long periods is prevented to thereby enhance the lifespan of emitters 16.

FIGS. 6–9 show partial plan views of rear substrate 2 used to describe modified examples of embodiments of the present invention.

Figure 6:
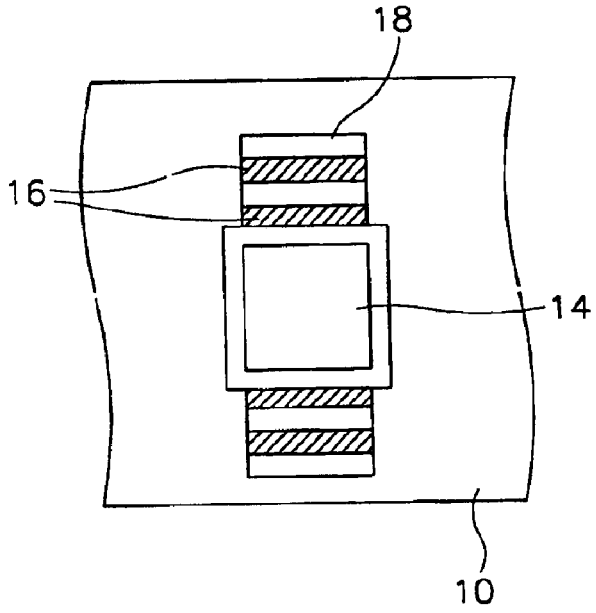
FIGS. 6–9 show partial plan views of a rear substrate used to describe modified examples of an embodiment of the present invention.

In the first modified example shown in FIG. 6, the same basic configuration as described above is used except that at least two of emitters 16 are provided in each of emitter-receiving sections 18. Hence, since electrons are emitted from along long edges of each of emitters 16 (i.e., four emitters for each pixel region), greater electron emission amounts and therefore denser electron beams are realized.

Figure 7:
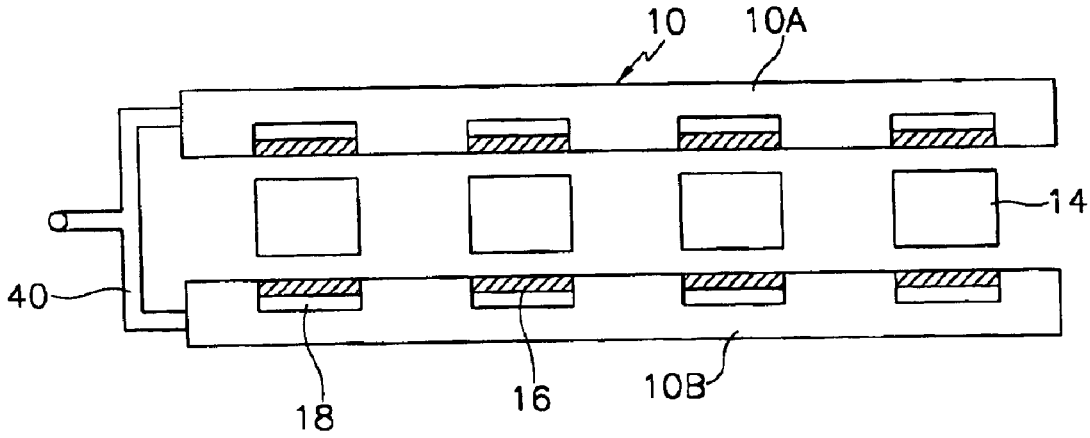

In the second modified example shown in FIG. 7, each of the cathode electrodes 10 is divided into first sub electrode 10A and a second sub-electrode 10B, and counter electrodes 14 are provided between first sub-electrode 10A and second sub electrode 10B. Emitter-receiving sections 18 are formed along edges of first electrode 10A and second electrode 10B closest to counter electrodes 14 and at locations corresponding to the same. Emitters 16 are provided in emitter-receiving sections 18 as described with reference to the previous embodiment of the present invention. First sub-electrode 10A and second sub-electrode 10B of each of cathode electrodes 10 are connected to common electrode 40 in order to receive the same voltage.

With this simplified structure of the second modified example over the embodiment described with reference to FIGS. 1–3, the chance of a short circuit occurring between counter electrodes 14 and cathode electrodes 10 during manufacture is significantly reduced.

In the third and fourth modified examples, a structure is realized such that when emitters 16 are mounted within emitter-receiving sections 18 and contacting cathode electrodes 10, contact areas between cathode electrodes 10 and emitters 16 are altered to adjust a contact resistance of emitters 16.

Figure 8:
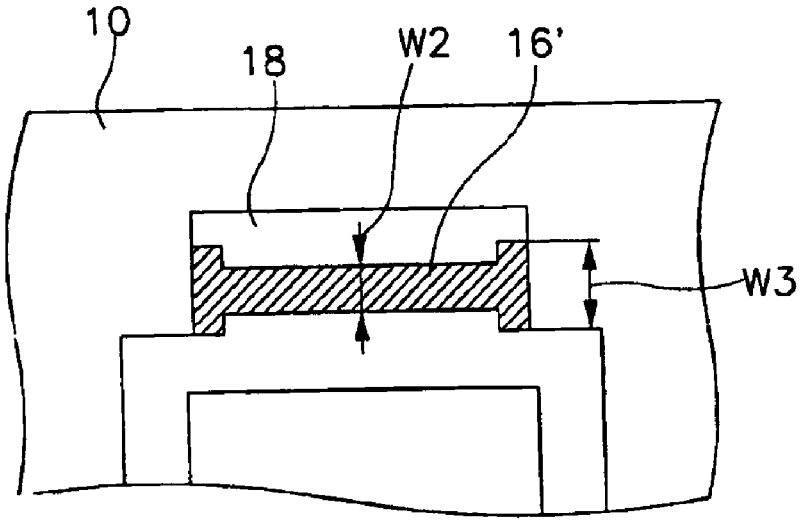

That is, in the third modified example, with reference to FIG. 8, widths W3 of short sides of emitters 16' are expanded to be greater than width W2 of a center portion of emitters 16' to increase the contact area with cathode electrodes 10.

Figure 9:
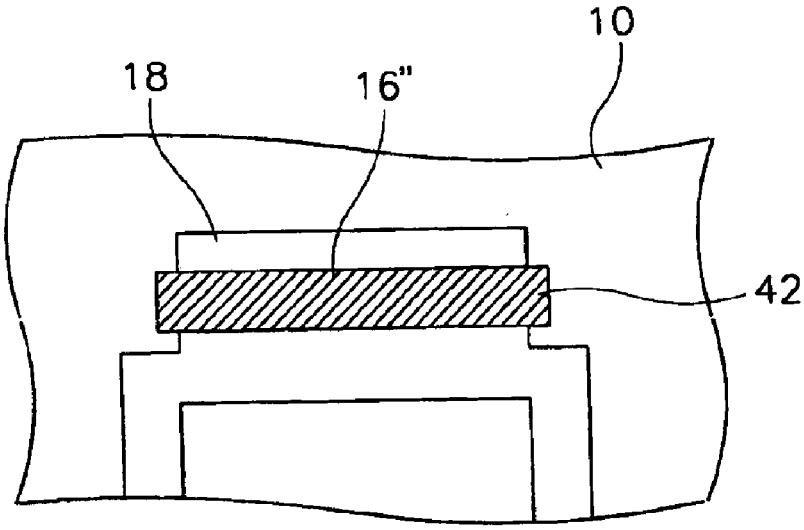

In the fourth modified example, with reference to FIG. 9, grooves 42 are formed in cathode electrodes 10 corresponding to a size and mounting position of short ends of emitters 16". The short ends of emitters 16" are then mounted within grooves 42, effectively increasing the contact area between emitters 16" and cathode electrodes 10.

In the third and fourth modified examples, the contact area between emitters 16' and 16" and cathode electrodes 10 is increased to thereby reduce contact resistance between these elements. As a result, interference given to electron emission by such contact resistance is prevented.

In the FED in accordance with embodiments of the present invention structured as described above, the electron beams emitted from the emitters are focused to realize sharp pictures, and blocking of the electron beams by the mesh grid is minimized to increase the utilization efficiency of the electron beams. Further, electrons are emitted from long edges of each of the emitters so that the electron beams cover a larger area and are more dense to thereby improve screen brightness. Finally, with the increase in the electron emission area of the emitters, the lifespan of the emitters is increased.

Figure 10:
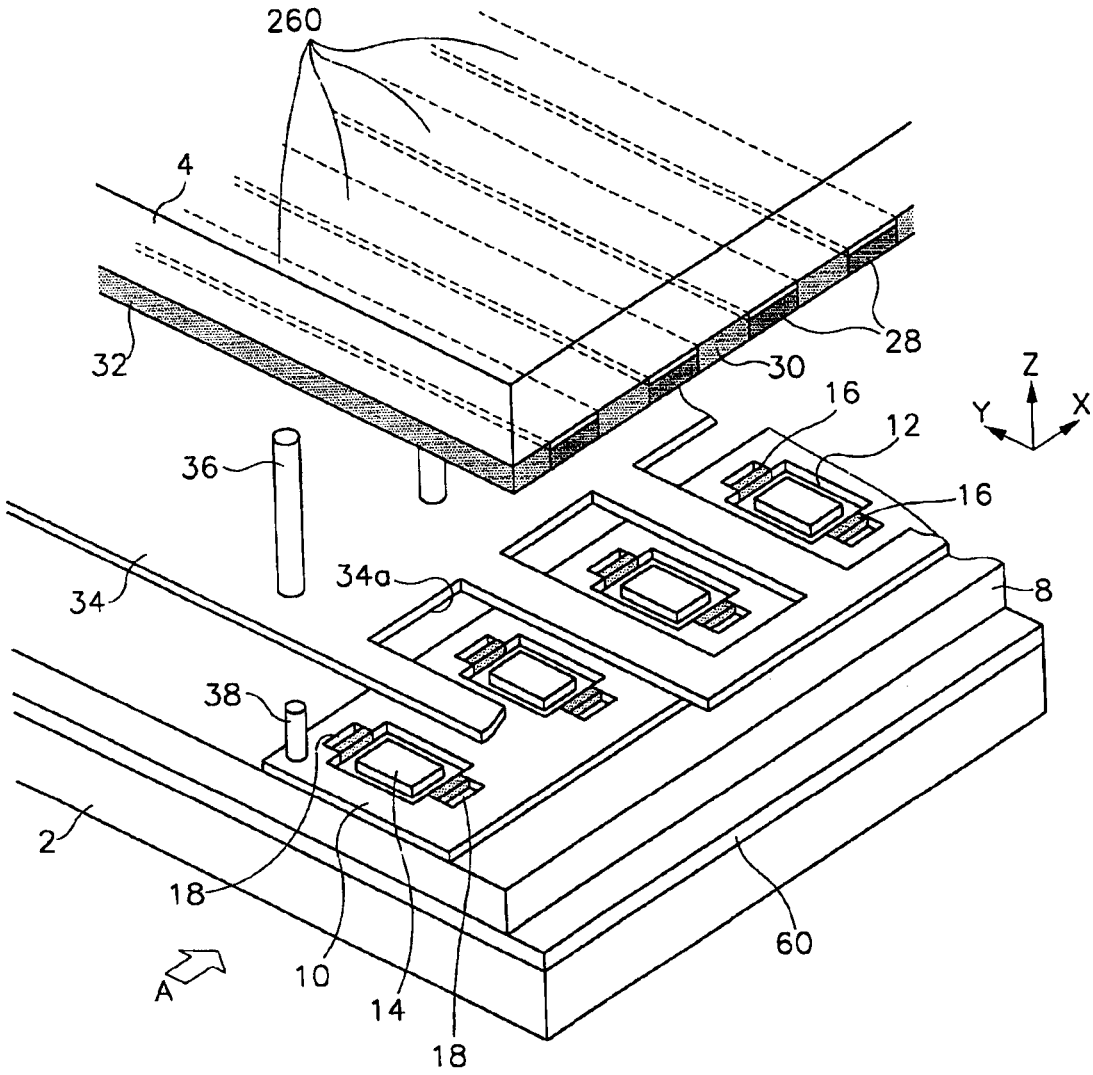
FIG. 10 is a partial exploded view of a field emission display according to a further embodiment of the present invention.

Those skilled in the art can appreciate that further embodiments of the present field emission display invention can be implemented. Referring to FIG. 10 for example, a plurality of anode electrodes 260 can be formed in a striped pattern while having one gate electrode 60 function as the common electrode. The remaining portions and their functions would be as described above for FIGS. 1–3 and the alternative embodiments shown in FIGS. 6–9. Those skilled in the art would then appreciate that the cathode electrodes could receive scanning information while the anode electrodes receive data information and vice versa.

Although several embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

For example, those skilled in the art can further appreciate that the embodiments of FIGS. 1 and 10 could have further alternative implementations. Referring to FIG. 1, gate electrodes 6 and cathode electrodes 10 could alternate locations relative to first insulation layer 8. Similarly, referring to FIG. 10, gate electrodes 60 and cathode electrodes 10 could alternate locations relative to first insulation layer 8.

Those skilled in the art can also appreciate that an anode electrode in the various embodiments can be formed by a metal film, rather than being made of transparent material such as ITO. When the anode electrode is formed by a metal film, a phosphor layer is formed on a front substrate and the metal layer is formed on the phosphor layer.

Those skilled in the art can still further appreciate that the configurations of substrates, gate electrodes, anode electrodes, insulation layers, thin film layers, black matrix layers, phosphor layers, mesh grids, spacers, emitters and emitter receiving sections shown in FIGS. 1, 2, 3, 6, 8, 9 and 10 can be applied as appropriate to the sub-electrode configuration shown in FIG. 7.

What is claimed is:

1. A field emission display device, comprising:

first and second substrates provided opposing one another with a predetermined gap therebetween;

at least one gate electrode formed in a predetermined pattern on the first substrate;

cathode electrodes formed in a predetermined pattern, the cathode electrodes including openings that are formed where the cathode electrodes intersect the gate electrode;

an insulation layer formed between the at least one gate electrode and the cathode electrodes;

counter electrodes formed in the openings and with predetermined dimensions such that predetermined gaps are formed between the counter electrodes and the cathode electrodes;

emitters contacting the cathode electrodes;

at least one anode electrode formed on the second substrate opposing the first substrate; and phosphor layers formed in a predetermined pattern on the anode electrode;

wherein two of the emitters are provided on opposite sides of each of the counter electrodes, each of the emitters including one long side in proximity to the corresponding counter electrode and two short sides contacting the corresponding cathode electrode.

2. The field emission display device of claim 1, wherein the counter electrodes contact a respective gate electrode through holes formed in the insulating layer such that the counter electrodes are electrically connected to the respective gate electrode.

3. The field emission display device of claim 1, wherein each of the cathode electrodes includes a pair of emitter-receiving sections formed by extending the openings of the cathode electrodes to predetermined dimensions on opposite sides of the counter electrodes.

4. The field emission display device of claim 3, wherein the emitters are provided within the emitter-receiving sections and with its short sides contacting the cathode electrodes such that the emitters close an entrance side of the emitter-receiving sections to thereby form spaces between the emitters and the cathode electrodes.

5. The field emission display device of claim 4, wherein lengths of the emitter-receiving sections and emitters in a direction along lengths of the cathode electrodes are substantially identical to a width of the counter electrodes along the same direction.

6. The field emission display device of claim 3, wherein the emitters include a second long side that is positioned at a predetermined distance from the cathode electrodes.

7. The field emission display device of claim 3, wherein two or more emitters are separately provided in each of the emitter-receiving sections.

8. The field emission display device of claim 3, wherein the cathode electrodes are each divided into a first sub electrode and a second sub electrode, the counter electrodes are positioned between the first and second sub electrodes, and the emitter-receiving sections are formed along edges of the first and second sub electrodes closest to the counter electrode.

9. The field emission display device of claim 8, wherein the emitters are provided within the emitter-receiving sections and with its short sides contacting the cathode electrodes such that the emitters close an entrance side of the emitter-receiving sections to thereby form spaces between the emitters and the cathode electrodes.

10. The field emission display device of claim 8, wherein the emitters include a second long side that is positioned at a predetermined distance from the cathode electrodes.

11. The field emission display device of claim 8, wherein lengths of the emitter-receiving sections and emitters in a direction along lengths of the cathode electrodes are substantially identical to a width of the counter electrodes along the same direction.

12. The field emission display device of claim 8, wherein the emitters are made of carbon-based material selected from the group consisting of carbon nanotubes, graphite, diamond, diamond-like carbon, $C_{60}$ (Fullerene), and a mixture of the carbon-based material.

13. The field emission display device of claim 8, wherein two or more emitters are separately provided in each of the emitter-receiving sections.

14. The field emission display device of claim 8, wherein the emitters are rectangular having long sides and short sides, and dimensions of the short sides are varied to control a contact area with the cathode electrodes.

15. The field emission display device of claim 8, wherein grooves are formed in side walls of the cathode electrodes within the emitter-receiving sections and ends of the emitters are inserted within the grooves to thereby vary a contact area of the emitters with the cathode electrodes.

16. The field emission display device of claim 8, further comprising a mesh grid mounted between the cathode electrodes and the anode electrode.

17. The field emission display device of claim 16, further comprising lower spacers mounted in non-pixel regions between the first substrate and the mesh grid, and upper spacers mounted in non-pixel regions between the second substrate and the mesh grid.

18. The field emission display device of claim 8, further comprising a metal thin film layer formed on the phosphor layers.

19. The field emission display device of claim 1, wherein the emitters are made of carbon-based material selected from the group consisting of carbon nanotubes, graphite, diamond, diamond-like carbon, $C_{60}$ (Fullerene), and a mixture of the carbon-based material.

20. The field emission display device of claim 1, wherein the emitters are rectangular having long sides and short sides, and dimensions of the short sides are varied to control a contact area with the cathode electrodes.

21. The field emission display device of claim 1, wherein grooves are formed in side walls of the cathode electrodes within the emitter-receiving sections and ends of the emitters are inserted within the grooves to thereby vary a contact area of the emitters with the cathode electrodes.

22. The field emission display device of claim 1, further comprising a mesh grid mounted between the cathode electrodes and the anode electrode.

23. The field emission display device of claim 22, further comprising lower spacers mounted in non-pixel regions between the first substrate and the mesh grid, and upper spacers mounted in non-pixel regions between the second substrate and the mesh grid.

24. The field emission display device of claim 1, further comprising a metal thin film layer formed on the phosphor layers.

25. A field emission display, comprising:

a first substrate;

at least one gate electrode formed in a predetermined gate electrode pattern on the first substrate;

a plurality of cathode electrodes formed in a predetermined cathode electrode pattern;

an insulation layer formed between the at least one gate electrode and the plurality of cathode electrodes emitters electrically contacting the cathode electrodes;

a second substrate opposing the first substrate with a predetermined gap therebetween, the first substrate and the second substrate forming a vacuum container;

at least one anode electrode formed in a predetermined anode electrode pattern on a surface of the second substrate opposing the first substrate; and phosphor layers formed in a predetermined phosphor layer pattern on the at least one anode electrode;

wherein a pixel region is formed between an emitter and a respective phosphor layer of the predetermined phosphor layer pattern at each intersection of:

a cathode electrode and a gate electrode when the anode electrode is a common anode electrode, or a cathode electrode and an anode electrode when the gate electrode is a common gate electrode;

wherein counter electrodes are formed in openings in the cathode formed at each intersection and with predetermined dimensions such that predetermined gaps are formed between the counter electrodes and the cathode electrodes;

wherein two of the emitters are provided on opposite sides of each of the counter electrodes, each of the emitters including one long side in proximity to the corresponding counter electrode and two short sides contacting the corresponding cathode electrode;

wherein predetermined voltages are applied to the at least one anode electrode, cathode electrodes and the at least one gate electrode generating an electric field between respective gate electrodes and the emitters such that electrons emitted from emitters are induced toward and strike the phosphor layer in a corresponding pixel region to realize predetermined images.

26. The field emission display of claim 25, wherein the at least one gate electrode formed in a predetermined gate electrode pattern is a plurality of gate electrodes formed in a striped pattern and the at least one anode electrode formed in a predetermined anode electrode pattern is one anode electrode functioning as the common electrode.

27. The field emission display of claim 25, wherein the at least one anode electrode formed in a predetermined anode electrode pattern is a plurality of anode electrodes formed in a striped pattern and the at least one gate electrode formed in a predetermined gate electrode pattern is one gate electrode functioning as the common electrode.

* * * * *